US007959334B2

(12) United States Patent
Tsai et al.

(10) Patent No.: US 7,959,334 B2
(45) Date of Patent: Jun. 14, 2011

(54) ASSEMBLY FOR FIXING AND CONNECTING LIGHT BAR LAMP

(75) Inventors: Cheng-Yu Tsai, Chupei (TW); Li-Wei Chen, Chupei (TW); Shiou-Shiung Cheng, Chupei (TW); Ching-Hsien Lin, Chupei (TW)

(73) Assignee: Alliance Optotek Co., Ltd., Hsinchu (TW)

( * ) Notice: Subject to any disclaimer, the term of this patent is extended or adjusted under 35 U.S.C. 154(b) by 644 days.

(21) Appl. No.: 12/114,902

(22) Filed: May 5, 2008

(65) Prior Publication Data

US 2008/0314944 A1 Dec. 25, 2008

(30) Foreign Application Priority Data

Jun. 21, 2007 (TW) ..... 96210060 U

(51) Int. Cl.
*F21V 21/00* (2006.01)

(52) U.S. Cl. ..... 362/396; 362/217.12; 362/217.13; 362/217.16; 362/217.17; 362/219

(58) Field of Classification Search ..... 362/382, 362/396, 432, 219, 217.1–217.13, 652, 647, 362/217.14–217.17
See application file for complete search history.

(56) References Cited

U.S. PATENT DOCUMENTS

| | | | | |
|---|---|---|---|---|
| 3,540,687 | A * | 11/1970 | Cuva | 248/223.41 |
| 3,927,315 | A * | 12/1975 | Werry | 362/382 |
| 4,535,393 | A * | 8/1985 | Aspenwall | 362/125 |
| 5,893,628 | A * | 4/1999 | Byers | 362/396 |
| 7,226,183 | B2 * | 6/2007 | Galli et al. | 362/191 |
| 7,331,687 | B1 * | 2/2008 | Noh | 362/219 |
| 7,719,437 | B2 * | 5/2010 | Bertram, III | 340/815.73 |

* cited by examiner

*Primary Examiner* — Bao Q Truong
(74) *Attorney, Agent, or Firm* — Chun-Ming Shih; HDLS IPR Services

(57) ABSTRACT

An assembly for fixing and connecting a polygonal LED light bar lamp includes a fixing seat, a covering plug, and an electrical connector. The fixing seat has a bottom with both edges thereof extending to form two bevels and parallel plates. The bottom and bevels have a penetrating hole, respectively. The covering plug has a cover having an insertion hole. Two electrode pins are disposed in the interior of the insertion hole. The electrical connector has a partitioning block. Both sides of the partitioning block have a protruding pillar, respectively. The protruding pillar is provided with a hollow pillar having electrodes for contacting with electrode pins. With the fixing seat being fixed on a carrier, the light bar can be held in the fixing seat with adjustable irradiating direction. Further, two light bars can be connected in series by the electrical connector.

13 Claims, 9 Drawing Sheets

ASSEMBLY FOR FIXING AND CONNECTING LIGHT BAR LAMP

BACKGROUND OF THE INVENTION

1. Field of the Invention

The present invention relates to a lamp, and in particular to a fixing and connecting structure of a light bar lamp.

2. Description of Prior Art

Light-emitting diodes are of small volume, long life, low electricity consumption, rapid response rate, and high resistance to vibration, and thus they are widely used in lighting or backlight sources, thereby replacing traditional bulbs, small fluorescent lamps or light-emitting elements of cold cathode lamps.

When the light-emitting diodes are applied to the lighting or backlight sources, the circuit board is designed to be square or rectangular shape according to the requirements for the lighting or backlight sources. For example, the circuit board is designed to be elongated, and a plurality of light-emitting diodes is soldered on the elongated circuit board, thereby forming a light bar. When this kind of LED light bar lamps are applied to a backlight source of a liquid crystal displayer (LCD), the LED light bar lamps can be mounted on the periphery of a light-guiding plate of the LCDs directly, thereby replacing the traditional cold cathode lamps. If the LED light bar lamps are applied to the lighting for exhibition, the LED light bar lamps have to be mounted in the interior of an elongated lamp seat first. Then, the elongated lamp seat is fixed to a wall or an inner wall of the exhibition cabinet, so that the light generated by the LED light bar lamps can illuminate the exhibited articles.

When the elongated lamp seats are fixed to the wall or the inner wall of an exhibition cabinet, since the LED light bar lamps can emit light in one direction only, it is impossible to adjust the irradiating direction. Further, when plural sets of LED light bar lamps are needed to be connected in series, the power transmission between two LED light bar lamps must be accomplished by connecting wires so as to deliver the power to each LED light bar lamp. However, the wiring process will spend a lot of time and labor. Further, if any one wire fails to generate a good or correct electrical contact, the related LED light bar lamps will not be lighted up. Alternatively, when the LED light bar lamps are damaged, it is not easy to detach and repair the damaged LED light bar lamps or re-connect the wires, causing the troubles in repair and maintenance.

SUMMARY OF THE INVENTION

The present invention is to solve the drawbacks of prior art and provide a fixing seat for assembling the LED light bar lamp on the wall of an inner wall of an exhibition cabinet. Via this arrangement, the irradiating direction of the LED light bar lamp can be adjusted. Further, via an electrical connector, plural sets of LED light bar lamps can be connected in series or disconnected for replacement easily.

The present invention provides an assembly for fixing and connecting a light bar lamp, which includes a polygonal fixing seat, a covering plug and an electrical connector. The polygonal fixing seat has a bottom edge with both ends thereof extending to form two symmetrical bevels respectively. Both ends of the two bevels extend to form two symmetrical parallel plates. Each end of the two parallel plates is provided with a buckling flange that is curved inwards slightly. Further, the bottom and one of the bevels have a penetrating hole thereon respectively. One of the buckling flanges is provided thereon with a notch. The penetrating hole and the notch allow a screw to pass through so as to lock the fixing seat onto a carrier.

The covering plug has a cover. One side of the cover is provided with a bar and an insert. The other side of the cover is provided with a positioning hole and an insertion hole. The positioning hole allows a positioning pillar to be inserted therein. The depth of the insertion hole extends into the insert. The interior of the insertion hole is provided with a needle-like and sheet-like electrode pin.

The electrical connector has a polygonal partitioning block. Both side surfaces of the partitioning block extend to form a protruding pillar respectively. The protruding pillar extends to form a hollow pillar thereon. The outside of the hollow pillar is covered by a metallic electrode that is brought into contact with the sheet-like electrode pin, while the inside of the hollow pillar has a metallic electrode that is brought into contact with the needle-like electrode pin. Further, a positioning pillar is provided on the partitioning block above the protruding pillar is provided with.

DETAILED DESCRIPTION OF THE INVENTION

The technical contents and detailed description of the present invention will be explained with reference to the accompanying drawings.

Figure 1:
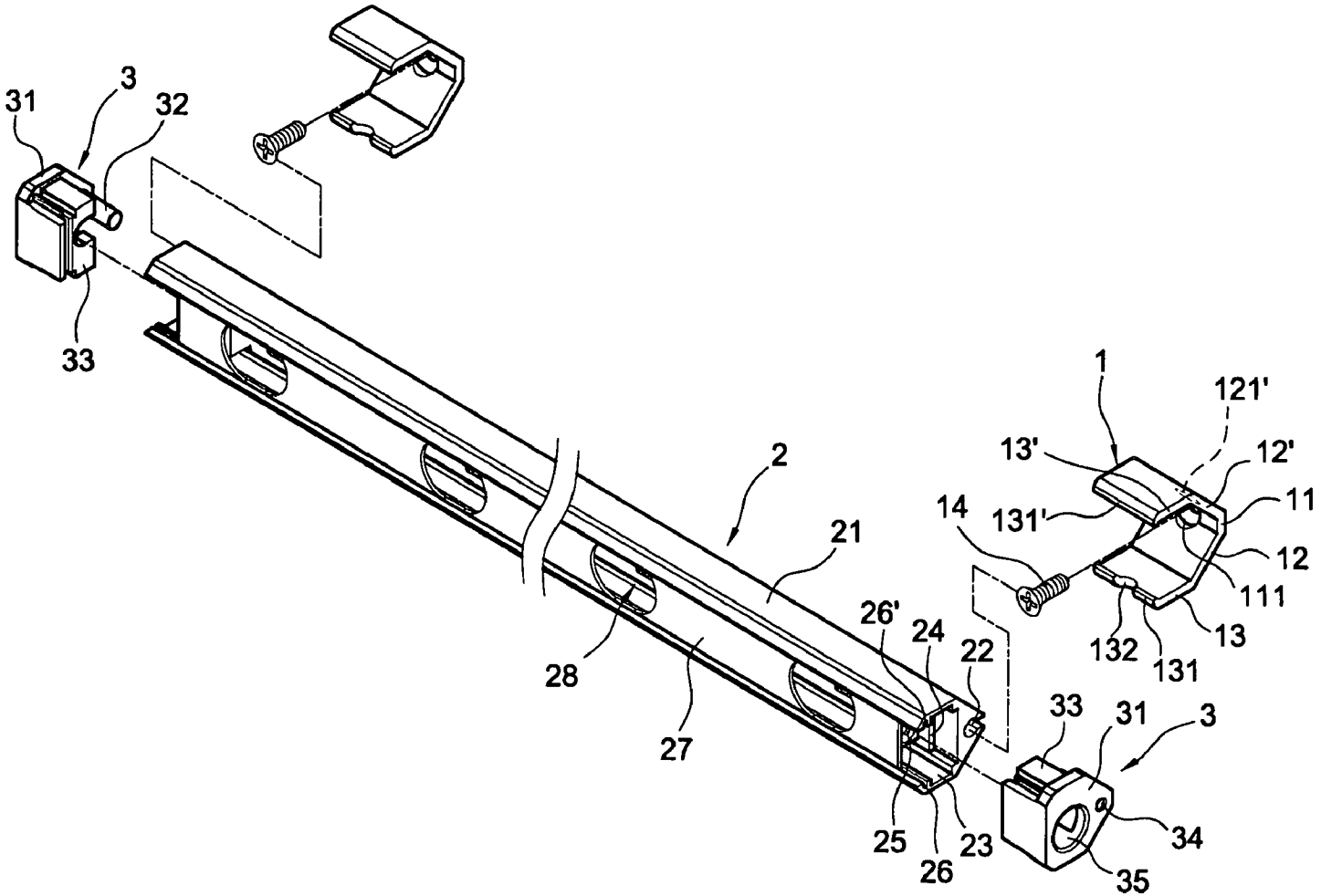
FIG. 1 is an exploded view showing the light bar lamp and the fixing assembly of the present invention.
Figure 2:
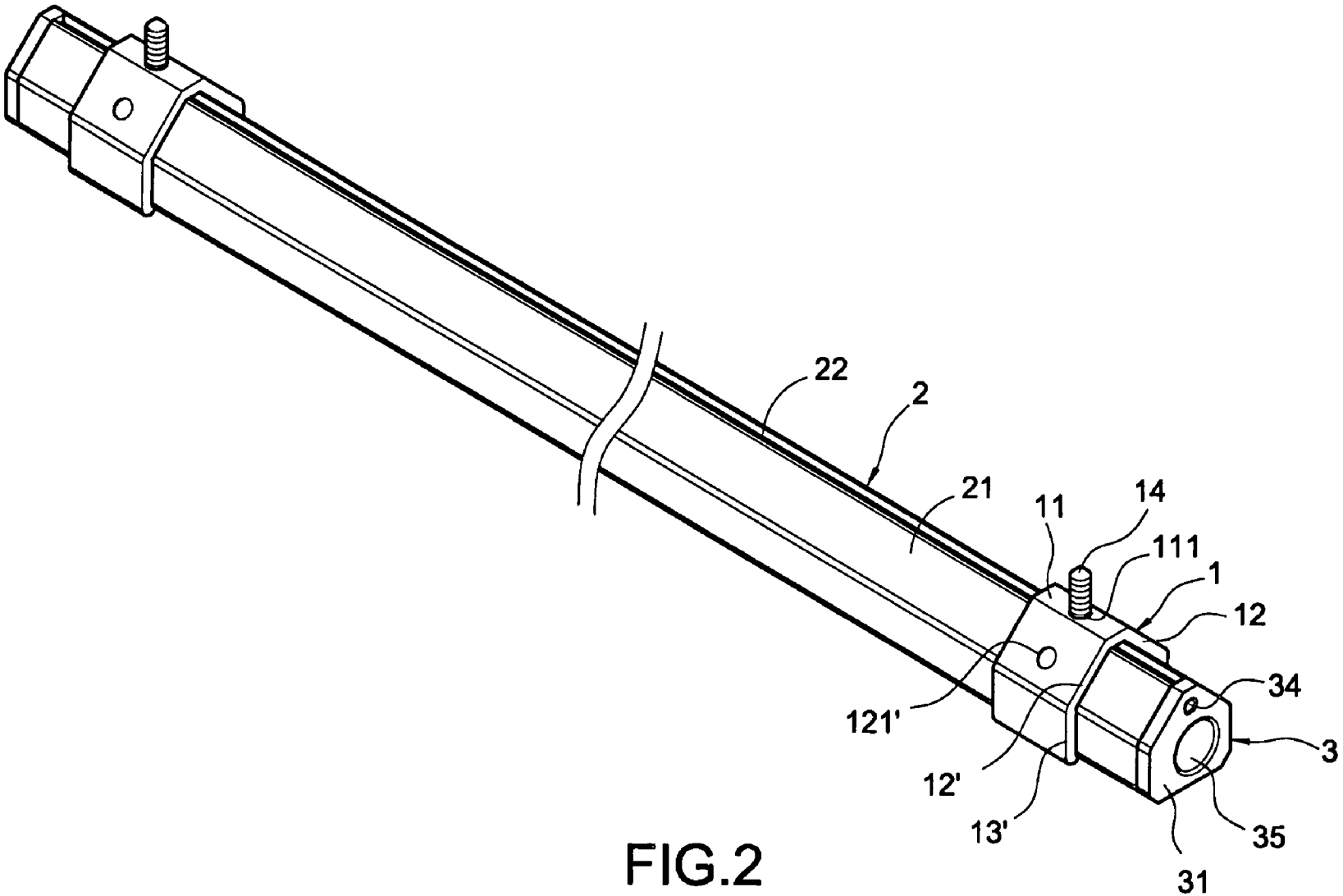
FIG. 2 is an assembled view showing the external appearance of the light bar lamp and the fixing assembly of the present invention.

FIG. 1 is an exploded view showing the light bar lamp and the fixing assembly of the present invention, and FIG. 2 is an assembled view showing external appearance of the light bar lamp and the fixing assembly of the present invention. As shown in these figures, the assembly for fixing a light bar lamp of the present invention includes a polygonal fixing seat 1, a polygonal light bar lamp 2 and two covering plugs 3.

The polygonal fixing seat 1 is one-side-opened pentagonal or hexagonal and made of metal or plastics allowing certain variability of shape. The polygonal fixing seat 1 has a bottom 11 thereon. Both edges of the bottom 11 are bent to form two symmetrical bevels 12, 12', respectively. The two bevels 12, 12' are bent to form two symmetrically parallel plates 13, 13', respectively. The bottom 11, bevels 12, 12' and parallel plates 13, 13' jointly form a substantial shape of C. An outward edge of each the parallel plate 13, 13' is provided with a buckling flange 131, 131' that is bent inwards. The bottom edge 11, the two bevels 12, 12', and the straight edges 13, 13' encloses to form the polygonal fixing seat 1 within which the polygonal light bar lamp 2 can be held. Both the bottom 1 and at least one of the bevels 12, 12' have a penetrating hole 111, 121', respectively. One of the buckling flanges 131, 131' is provided with a notch 132. The penetrating holes 111, 121' and the notch 132 allow a screw 14 to pass through so as to lock the fixing seat 1 to a carrier (described later). Further, the orientation of the fixing seat 1 can be adjusted. In the drawings, in addition to the screw 14, double-side adhesives or hook-and-loop fasteners (Velcro) can be used to fix the polygonal fixing seat 1 to the carrier.

The polygonal light bar lamp 2 has an aluminum polygonal casing 21 whose outline is corresponding to the polygonal fixing seat 1. The surface of the casing 21 is provided with a longitudinal slot 22, while the inside thereof is provided with an accommodating trough 23 formed into a substantially square or rectangular shape. The accommodating trough 23 is used to accommodate a circuit board 24. The circuit board 24 is provided thereon with a plurality of light-emitting diodes 25. One side of the accommodating trough 23 is provided with symmetrical insertion slots 26, 26' adjacent to an opening 28. The insertion slots 26, 26' allows a light mask 27 to be inserted therein. The light mask 27 is provided thereon with a plurality of through holes 28. The through holes 28 allow the light generated by the light-emitting diodes 25 to emit therethrough.

The covering plug 3 is made of rubber or plastics. The covering plug 3 has a plate-like cover 31 One side of the cover 31 is provided with a cylindrical bar 32 and an insert 33. The cross-sectional shape of the insert 33 corresponds to that of accommodating trough 23, the insertion slots 26, 26' and the opening 28. When the covering plug 3 is assembled with the casing 21, the bar 32 inserts into the longitudinal slot 22 with the insert 33 assembling into the accommodating trough 23, the insertion slots 26, 26' and the opening 28. Further, the other side of the cover 31 is provided with a positioning hole 34 and an insertion hole 35. The depth of the insertion hole 35 extends into the insert 33 for delivering the electric power.

Figure 3:
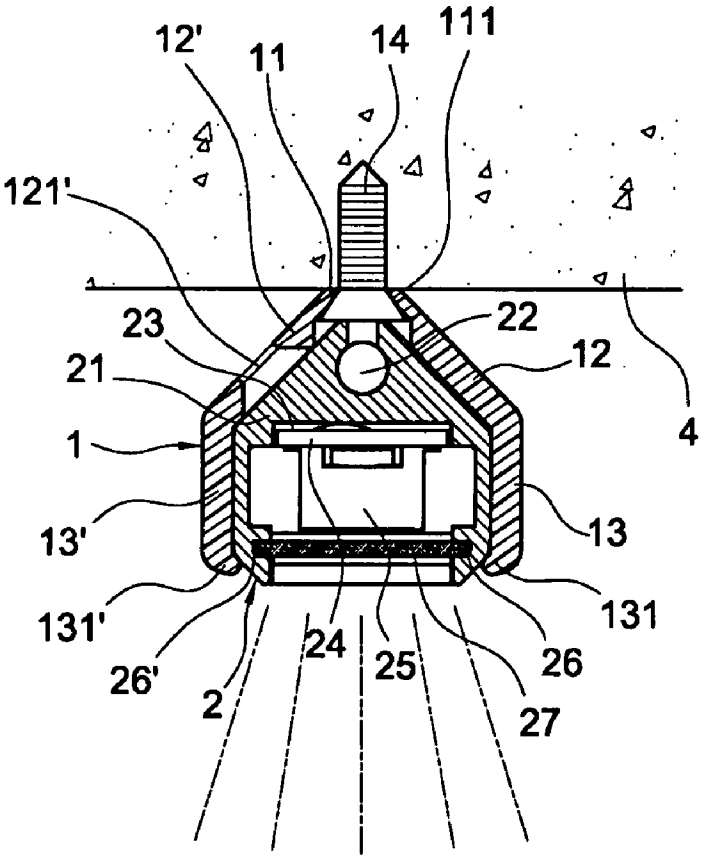
FIG. 3 is a schematic view showing the first operating state of the present invention.

Please refer to FIG. 3, which is a schematic view showing the first operating state of the present invention. As shown in this figure, when the polygonal light bar lamp 2 is in use, the screw 14 is allowed to pass through the penetrating hole 111 of the bottom 11 of the polygonal fixing seat 1 first, thereby fixing the polygonal fixing seat 1 on the carrier 4. The carrier 4 may be a wall or cabinet. After the polygonal fixing seat 1 is fixed, the polygonal light bar lamp 2 can be embedded in the polygonal fixing seat to be held, thereby making the light generated by the polygonal light bar lamp 2 to irradiate downwards. If the irradiating direction is required to change, all the user needs to do is detaches the screw 14 and reinstalls the light bar lamp 2.

Figure 4:
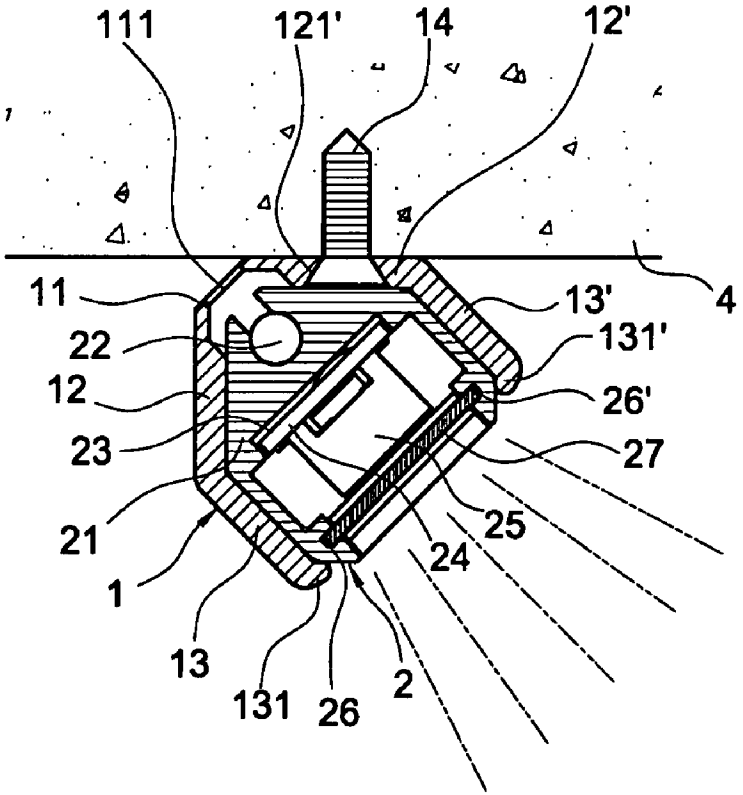
FIG. 4 is a schematic view showing the second operating state of the present invention.

Please refer to FIG. 4, which is a schematic view showing the second operating state of the present invention. As shown in this figure, when the polygonal light bar lamp 2 of the present invention is in use, the screw 14 is allowed to pass through the penetrating hole 121' on the bevel 12' of the polygonal fixing seat 1, thereby fixing the polygonal fixing seat 1 on the carrier 4. After the polygonal fixing seat 1 is fixed in this manner, the polygonal light bar lamp 2 can be embedded in the polygonal fixing seat 1 to be held, thereby making the light generated by the polygonal light bar lamp 2 to irradiate down-rightwards.

Figure 5:
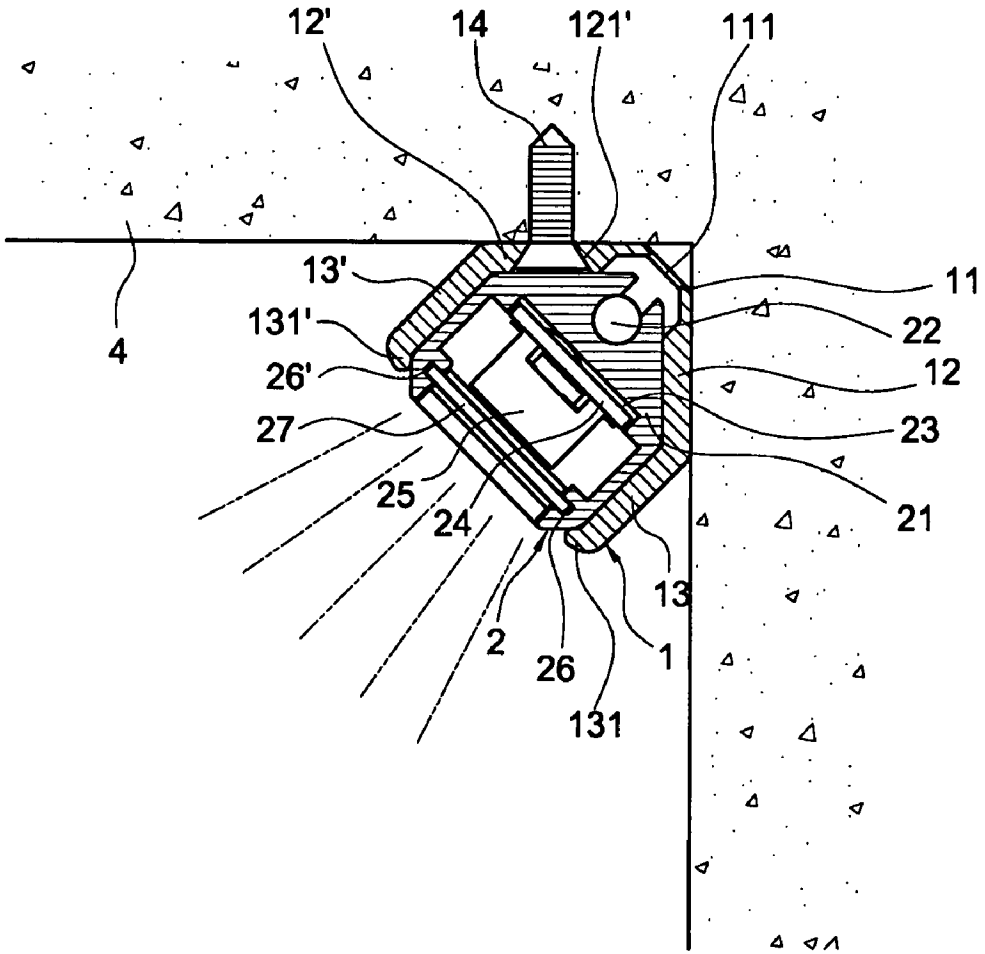
FIG. 5 is a schematic view showing the third operating state of the present invention.
Figure 7:
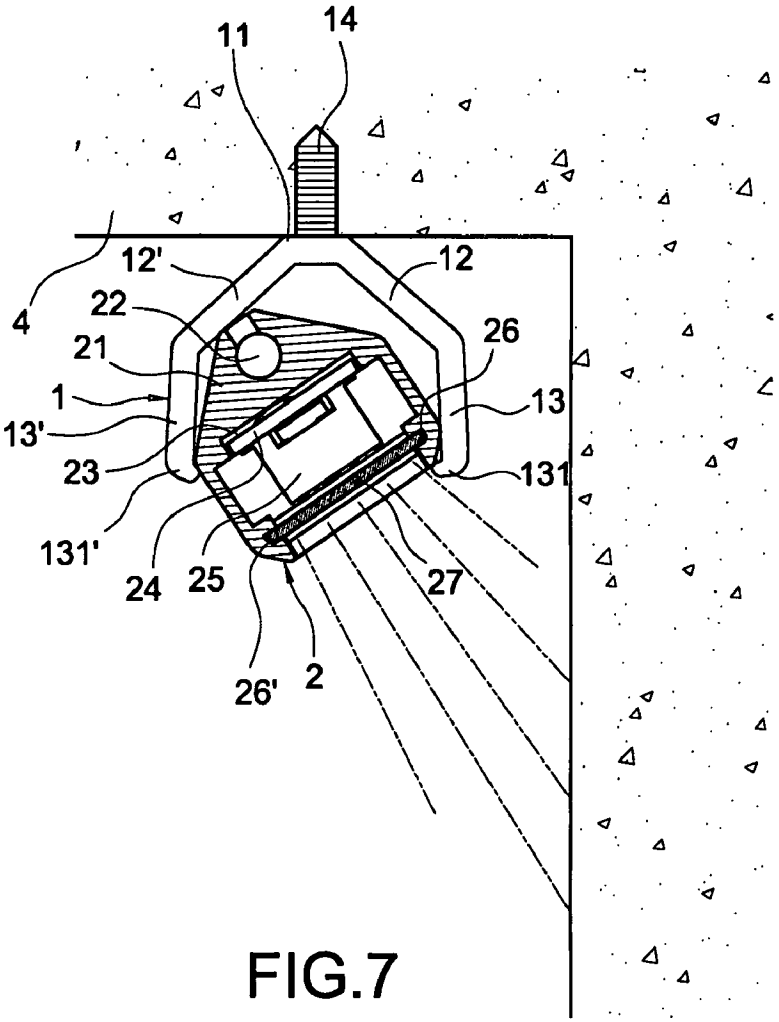
FIG. 7 is a schematic view showing the fifth operating state of the present invention.
Figure 6:
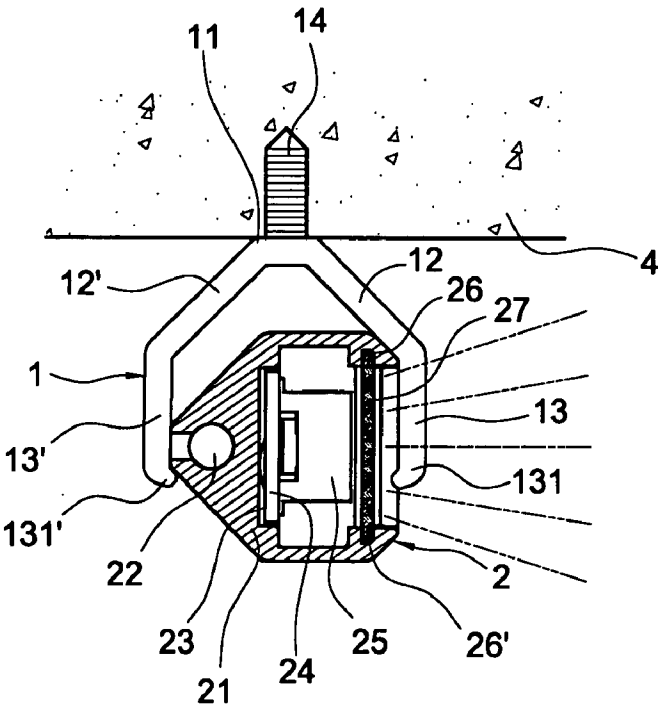
FIG. 6 is a schematic view showing the fourth operating state of the present invention.

Please refer to FIG. 5, which is a schematic view showing the third operating state of the present invention. As shown in this figure, when the polygonal light bar lamp 2 of the present invention is in use, the screw 14 is allowed to pass through the penetrating hole 121' on the bevel 12' of the polygonal fixing seat 1, thereby fixing the polygonal fixing seat 1 on a corner of the carrier 4. After the polygonal fixing seat 1 is fixed in this manner, the polygonal light bar lamp 2 can be embedded in the polygonal fixing seat 1, thereby making the light generated by the polygonal light bar lamp 2 to irradiate down-leftwards. Please refer to FIGS. 6 and 7, which are schematic views showing the fourth and fifth operating states of the present invention, respectively. As shown in these figures, when the polygonal light bar lamp 2 of the present invention is in use, the screw 14 is allowed to pass through the penetrating hole 111 on the bottom 11 of the polygonal fixing seat 1, thereby fixing the polygonal fixing seat 1 on the carrier 4. After the polygonal fixing seat 1 is fixed on the carrier 4, the polygonal light bar lamp 2 can be embedded in the polygonal fixing seat 1 along a desired irradiating direction, so that the polygonal light bar lamp 2 can be assembled on the polygonal fixing seat 1. If the irradiating direction is required to change, an alternative solution is to detach the polygonal light bar lamp 2 from the polygonal fixing seat 1 and reinstall the light bar lamp 2 on the polygonal fixing seat 1 with changing the included angle between the both as shown in FIG. 7. Therefore, the irradiating direction of the polygonal light bar lamp 2 can be simply changed.

Figure 8:
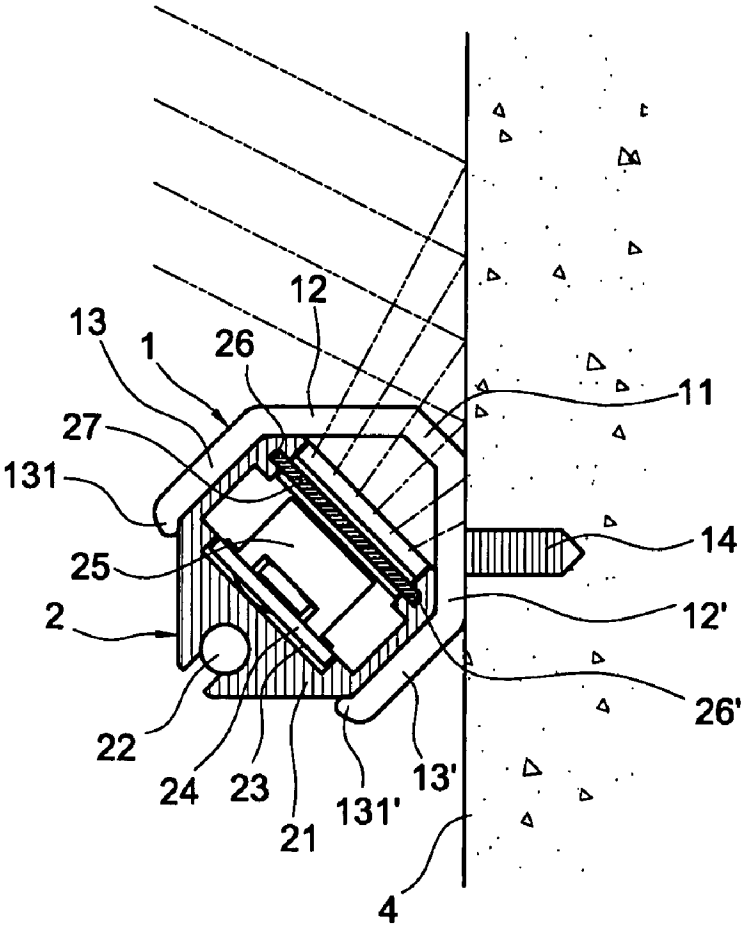
FIG. 8 is a schematic view showing the sixth operating state of the present invention.

Please refer to FIG. 8, which is a schematic view showing the sixth operating state of the present invention. As shown in this figure, the screw 14 is allowed to pass through the penetrating hole 121' on the bevel 12' of the polygonal fixing seat 1, so that the polygonal fixing seat 1 can be fixed on the carrier 4. The polygonal light lamp 2 also can be embedded in the polygonal fixing seat 1 in a direction of facing inwards. The polygonal light bar lamp 2 thus irradiates the light on the surface of the carrier 4 and then the light is reflected by the surface to a desired location. In this way, the polygonal light bar lamp 2 can be adjusted directly in the polygonal fixing seat 1 depending on the practical requirements, so that the user can adjust the irradiated region easily and conveniently.

Figure 9:
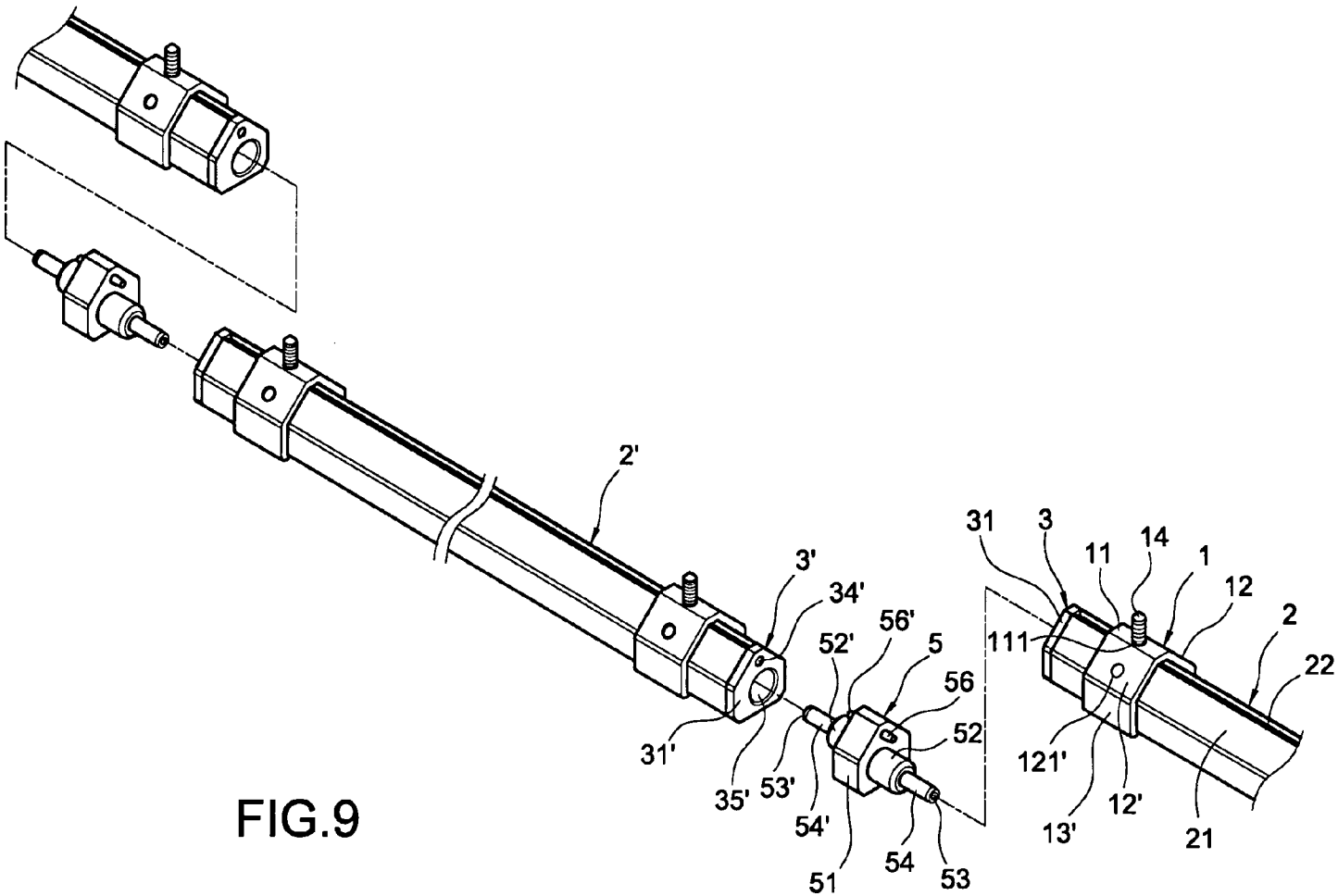
FIG. 9 is a schematic view showing another embodiment of the present invention.

Please refer to FIG. 9, which is a schematic view showing another embodiment of the present invention. As shown in this figure, in the present embodiment, an electrical connector 5 is connected between the first light bar lamp 2 and the second light bar lamp 2', thereby electrically connecting the light bar lamps 2 in series. The electrical connector 5 has a partitioning block 51. Both side surfaces of the partitioning block 51 extend to form a cylindrical protruding pillar 52, 52', respectively. The protruding pillars 52, 52' extend to form a hollow pillar 53, 53', respectively. The outside of the hollow pillar 53, 53' is covered with a electrode 54, 54', while the inside thereof has another electrode 55, 55'. The partitioning block 31 is provided with a cylindrical positioning pillar 56, 56' above the protruding pillar 52, 52', respectively.

Further, the positioning pillar 56 or 56' can be inserted into the positioning hole 34. The depth of the insertion hole 35 extends into the insert 33. Two electrode pin 36, 37 are disposed in the insertion hole 35, thereby contacting the electrodes 54 and 55 so as to delivering the electric power. In the drawings, the positioning pillars 56, 56' are designed to be foolproof, thereby avoiding erroneous insertion.

Figure 10:
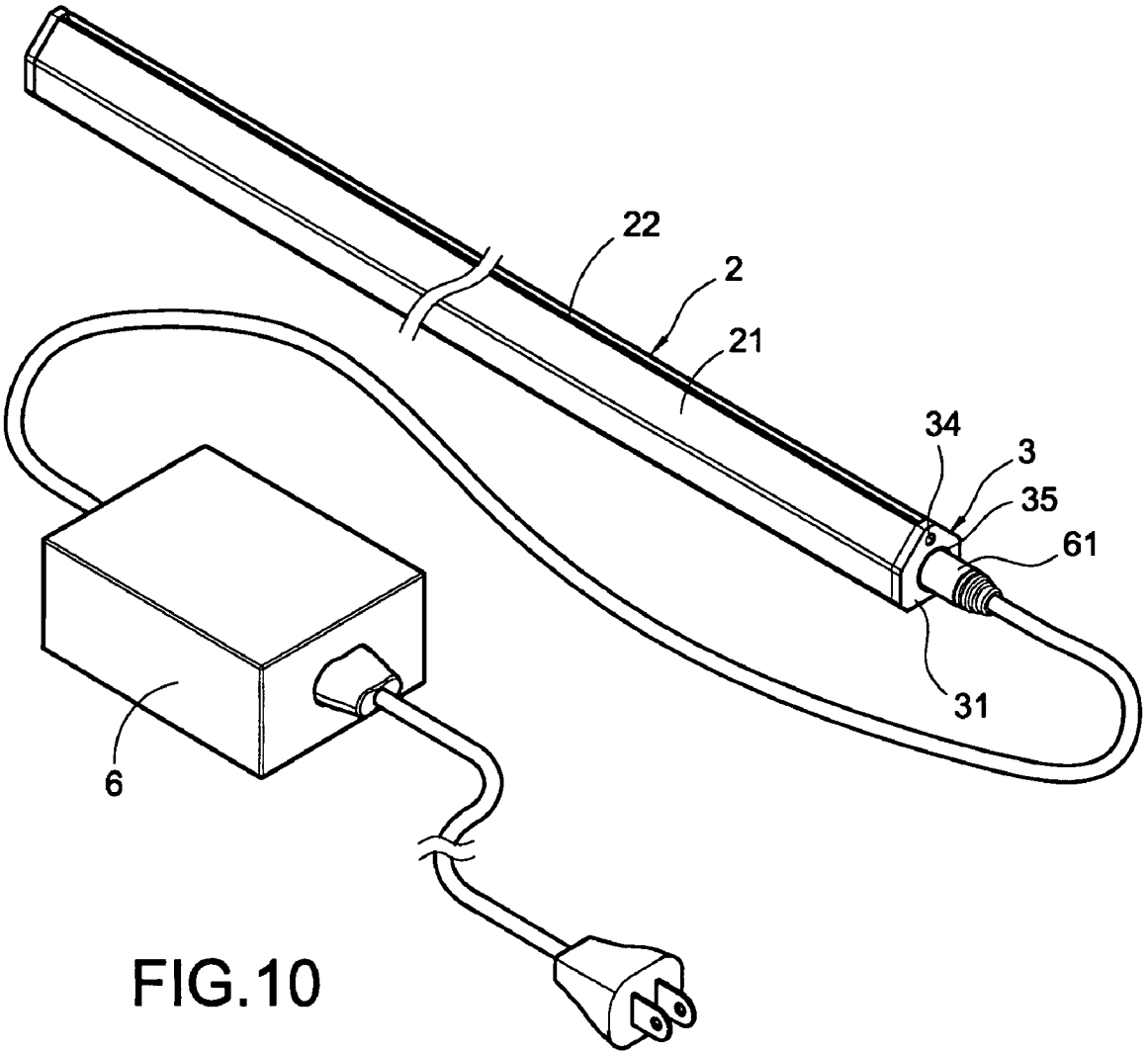
FIG. 10 is an assembled view showing the light bar lamp of the present invention being assembled with a power supply.
Figure 11:
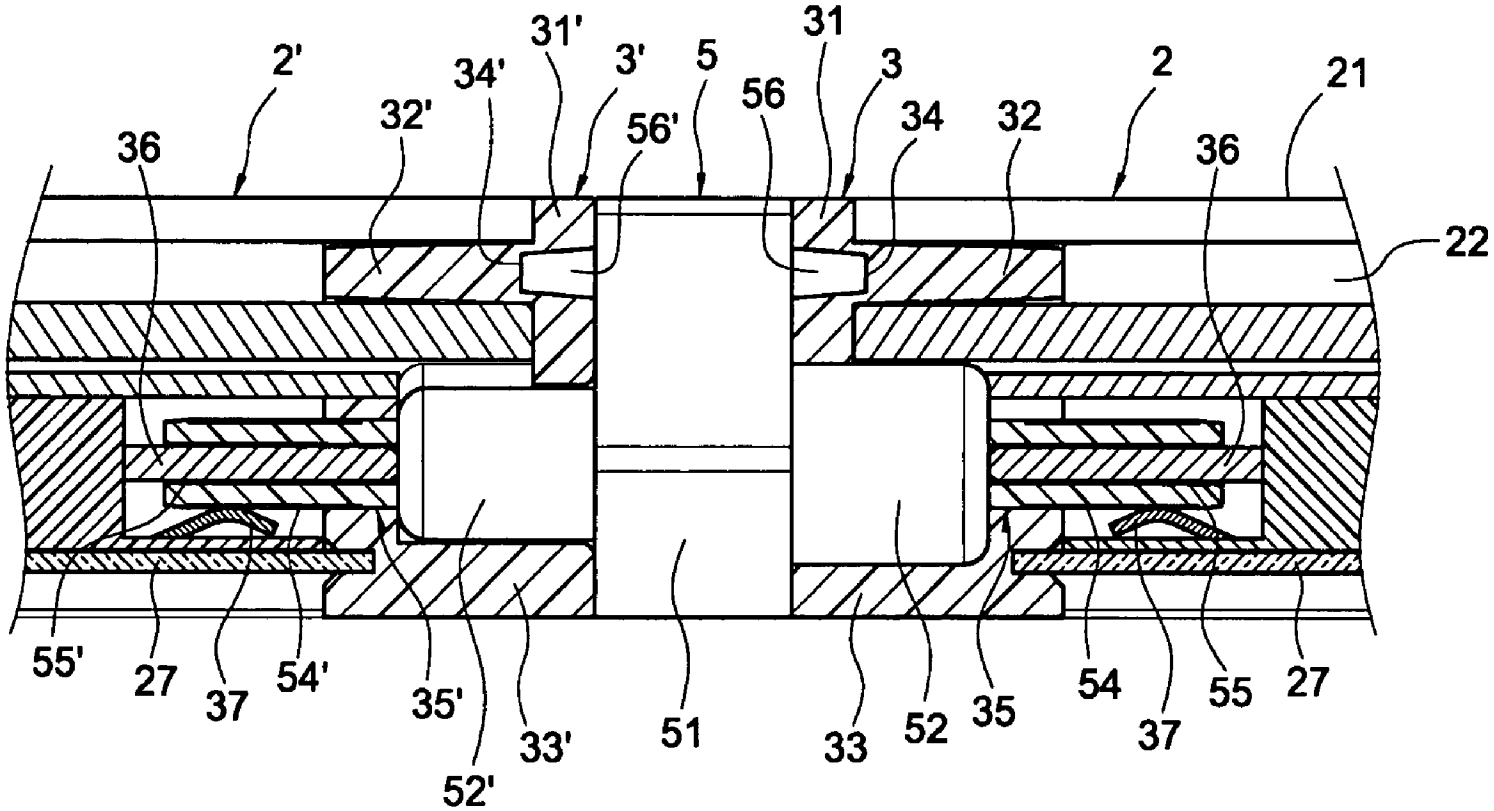
FIG. 11 is a cross-sectional view showing the light bar lamp of the present invention being connected to an electrical connector.

FIG. 10 is an assembled view showing the light bar lamp of the present invention being assembled with a power supply, and FIG. 11 is a cross-sectional view showing the light bar lamp of the present invention being connected to an electrical connector. As shown in these figures, when the insertion hole 35 of the covering plug 3 of the first light bar lamp 2 is inserted by an electrode pin 61 of a power supply 6, the power supply 6 inputs the power to the first light bar lamp 2. Then, the hollow pillar 53 of the electrical connector 5 is inserted into the insertion hole 35 of the other covering plug 3 of the first light bar lamp 2. In this way, the metallic electrode 55 is brought into electrical contact with the needle-like electrode pin 36, and the metallic electrode 54 is brought into electrical contact with the sheet-like electrode pin 37. The positioning pillar 56 is inserted into the positioning hole 34, so that the electrical connector 5 will not get loosened. On the other hand, the other electrode pin 53' of the electrical connector 5 is inserted into the insertion hole 35' of the covering plug 3' of the second light bar lamp 2'. In this way, the metallic electrode 55' of the hollow pillar 53' is brought into electrical contact with the needle-like electrode pin 36', and the metallic electrode 54' is brought into electrical contact with the sheet-like electrode pin 37'. The positioning pillar 56' is inserted into the positioning hole 34', so that the electrical connector 5 will not get loosened. Via this arrangement, the power of the first light bar lamp 2 can be delivered to the second light bar lamp 2', thereby achieving the electrical connection of plural sets of light bar lamps in series.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A fixing seat (1) for a light bar lamp (2), comprising:
a bottom (11);
two bevels (12, 12'), angledly extended from two opposite edges of the bottom (1), respectively; and
two parallel plates (13, 13'), angledly extended from the two bevels (12, 12'), respectively;
wherein both the bottom (11) and one of the two bevels (12, 12') have a penetrating hole (111, 121'), respectively,
wherein an outward edge of each of the two parallel plates (13, 13') is provided with a buckling flange (131, 131'), and
wherein one of the two buckling flanges (131, 131') is provided with a notch (132).

2. The fixing seat according to claim 1 being made of metal or plastics.

3. The fixing seat according to claim 1 being formed into an open pentagonal or hexagonal shape.

4. The fixing seat according to claim 1, wherein the notch (132) allows a screw (14) to pass therethrough.

5. The fixing seat according to claim 1, wherein the penetrating hole (111, 121') allows a screw (14) to pass therethrough.

6. The fixing seat according to claim 1, wherein the polygonal fixing seat (1) is fixed on the carrier (4) by means of double-side adhesives or hook-and-loop fasteners.

7. An assembly for connecting two light bar lamps (2, 2') in series, the connecting assembly comprising:
a covering plug (3) for covering both ends of the light bar lamp (2), the covering plug (3) having a cover (31) thereon, one side of the cover (31) being provided with a bar (32) and an insert (33), the other side of the cover (31) being provided with a positioning hole (34) and an insertion hole (35), the positioning hole (34) being inserted by a positioning pillar (56), the depth of the insertion hole (35) extending into the insert (33), two electrode pins (36, 37) being disposed in the insertion hole (35);
an electrical connector (5) having thereon a partitioning block (51), both sides of the partitioning block (51) extending to form a protruding pillar (52, 52'), respectively, the protruding pillar (52, 52') extending to have a hollow pillar (53, 53') thereon, the interior of the two hollow pillars (53, 53') having an electrode (55, 55') in contact with the electrode pin (36, 36'), and another electrode (55, 55') covering the outside of the hollow pillar (53, 53') being in contact with the other electrode pin (37, 37').

8. The assembly for connecting a light bar lamp according to claim 7, wherein the covering plug (3) is made of rubber or plastics.

9. The assembly for connecting a light bar lamp according to claim 7, wherein the cover (31) has a plate-like shape.

10. The assembly for connecting a light bar lamp according to claim 7, wherein the bar (32) is cylindrical.

11. The assembly for connecting a light bar lamp according to claim 7, wherein the partitioning block (51) is polygonal.

12. The assembly for connecting a light bar lamp according to claim 7, wherein the protruding pillar (52, 52') is circular.

13. The assembly for connecting a light bar lamp according to claim 7, wherein a positioning pillar (56, 56') is arranged on the partitioning block (51) above the protruding pillar (52, 52').

* * * * *